US011877664B1

(12) United States Patent
Hinnant

(10) Patent No.: US 11,877,664 B1
(45) Date of Patent: Jan. 23, 2024

(54) DUAL AIR CHAMBER STRUCTURE AND METHOD FOR USING

(71) Applicant: Edward Hinnant, Ellijay, GA (US)

(72) Inventor: Edward Hinnant, Ellijay, GA (US)

( * ) Notice: Subject to any disclaimer, the term of this patent is extended or adjusted under 35 U.S.C. 154(b) by 412 days.

(21) Appl. No.: 17/374,196

(22) Filed: Jul. 13, 2021

Related U.S. Application Data

(62) Division of application No. 15/247,404, filed on Aug. 25, 2016, now Pat. No. 11,083,309.

(60) Provisional application No. 62/267,136, filed on Dec. 14, 2015.

(51) Int. Cl.
*A47C 27/08* (2006.01)
*A47C 27/10* (2006.01)
*B63B 7/00* (2020.01)

(52) U.S. Cl.
CPC ..... *A47C 27/081* (2013.01); *A47C 27/084* (2013.01); *A47C 27/10* (2013.01); *B63B 7/00* (2013.01)

(58) Field of Classification Search
CPC ..... A47C 27/081; A47C 27/084; A47C 27/08; A47C 27/10; A61G 7/05769; A61G 7/05776; B63B 7/00
USPC ..... 5/710, 713, 706, 654, 655.3, 644
See application file for complete search history.

(56) References Cited

U.S. PATENT DOCUMENTS 2,241,847 A * 5/1941 Eberhard ..... B60C 29/007 137/861
3,008,465 A * 11/1961 Gal ..... A61G 7/05776 601/149
3,276,047 A * 10/1966 Emery ..... A47C 7/021 297/452.41
3,705,429 A * 12/1972 Nail ..... A47C 27/081 297/284.3
5,113,539 A * 5/1992 Strell ..... A47C 27/10 297/284.3
5,598,593 A * 2/1997 Wolfe ..... A47C 27/087 5/710
5,640,731 A * 6/1997 Toedter ..... A47C 27/081 5/713
5,774,917 A * 7/1998 Liu ..... A61G 7/05776 5/710
5,907,878 A * 6/1999 Thomas ..... A47C 27/082 5/710
5,918,336 A * 7/1999 Lee ..... A61G 7/05776 5/713
5,960,495 A * 10/1999 Hsu ..... A47C 27/087 5/710

(Continued)

*Primary Examiner* — Robert G Santos

(74) *Attorney, Agent, or Firm* — GRONHOLM PATENT SERVICES

(57) ABSTRACT

A dual air chamber structure having two independent and air impervious chambers, with each chamber being inflated and deflated by a separate air valve. The inner chamber, except for its air valve, is completely contained by the outer chamber and is comprised of a primary horizontal conduit and a plurality of inflatable intermittent vertical posts made of small diameter tubing which are connected by a corresponding plurality of horizontal conduit made of small diameter tubing, such that the inner chamber as a whole is comprised of a repeating series of inflatable vertical posts followed by inflatable horizontal connectors. The outer chamber forms an air impervious bladder around the inner chamber, except for the air valve of the inner chamber.

15 Claims, 6 Drawing Sheets

(56) References Cited

U.S. PATENT DOCUMENTS 6,047,423 A * 4/2000 Larson ..... A47C 27/10 5/709
6,098,223 A * 8/2000 Larson ..... A47C 27/088 5/713
6,112,350 A * 9/2000 Larson ..... A47C 27/10 5/710
6,212,719 B1 * 4/2001 Thomas ..... A47C 27/081 601/149
6,446,289 B1 * 9/2002 Su ..... A47C 27/18 5/709
6,463,610 B1 * 10/2002 Shulte ..... A47C 27/087 5/710
6,651,277 B1 * 11/2003 Marson ..... A47C 27/15 5/709
6,701,559 B2 * 3/2004 Boso ..... A47C 27/082 5/713
6,763,540 B1 * 7/2004 Wang ..... A47C 27/10 5/713
7,120,950 B2 * 10/2006 Garrigues ..... A47C 27/18 5/656
7,181,795 B2 * 2/2007 Wu ..... A47C 27/081 5/710
7,434,283 B2 * 10/2008 Wilkinson ..... A47C 27/10 5/713
8,584,287 B2 * 11/2013 Hrubant ..... A47C 27/10 5/709
8,590,079 B2 * 11/2013 Habegger ..... A61G 7/05769 5/713
8,671,487 B2 * 3/2014 Dewell ..... A47C 27/10 5/713
9,271,579 B2 * 3/2016 Riley ..... A47C 27/10
9,756,955 B2 * 9/2017 Alder ..... A47C 27/081
11,083,309 B2 * 8/2021 Hinnant ..... A47C 27/10
2006/0174416 A1 * 8/2006 Wu ..... A47C 27/081 5/710
2009/0320211 A1 * 12/2009 Lau ..... A47C 27/087 5/713
2011/0154574 A1 * 6/2011 Hrubant ..... A47C 27/10 156/60
2013/0061399 A1 * 3/2013 Dewell ..... A47C 27/10 5/713
2013/0331749 A1 * 12/2013 Borden ..... A61H 9/0092 601/151
2013/0340164 A1 * 12/2013 Brensinger ..... A47C 27/10 5/420
2015/0209206 A1 * 7/2015 Bargellini ..... A61G 5/1045 297/217.2
2016/0007763 A1 * 1/2016 Alder ..... A47C 27/087 5/706
2016/0128490 A1 * 5/2016 Cheng ..... A47C 4/54 5/655.3
2017/0164760 A1 * 6/2017 Hinnant ..... A47C 27/10

* cited by examiner

DUAL AIR CHAMBER STRUCTURE AND METHOD FOR USING

CROSS REFERENCES

This application claims the benefit of U.S. Provisional Application No. 62/267,136, filed Dec. 14, 2015. The provisional application identified above is incorporated by reference in its entirety to prove continuity of disclosure. Similar priority and incorporation applies for pending appn 15247404 filed 2016 Aug. 25.

BACKGROUND OF THE INVENTION

Portable, inflatable devices are well known in the outdoor industry. A typical inflatable pad incorporates an air impervious bladder and a separate valve for inflating and deflating the bladder. One problem associated with typical inflatable pads is the time and air it takes to inflate them. In response, some inventors have chosen to develop self-inflating pads. These self-inflating pads may incorporate an air impervious bladder, similar to the inflatable pads, but utilize some object, such as open cell foam, that causes the bladder to expand without assistance by the user. The addition of the open cell foam increases the weight of the inflatable pad and increases the time for the pad to fully inflate. This same scope of problems can be seen throughout the outdoor inflatable industry. The current disclosure serves to remedy many of these problems.

BRIEF SUMMARY OF THE INVENTION

Disclosed is a dual air chamber structure having two independent and air impervious chambers, with each chamber being inflated and deflated by a separate valve. The (first) inner chamber, except for its air valve, is completely contained by the (second) outer chamber and is comprised of a plurality of inflatable intermittent vertical posts made of small diameter tubing which are connected by a corresponding plurality of inflatable horizontal connectors made of small diameter tubing, such that air is free to flow between the vertical and horizontal elements. The inner chamber as a whole is comprised of a repeating series of inflatable vertical posts followed by inflatable horizontal connectors.

The inner surface of the outer chamber may contact the top and bottom of each vertical post of the inner chamber, thereby sealing the top and bottom of each vertical post. As the inner chamber inflates, the vertical posts stand up, thereby providing a mechanism to force the sides of the outer chamber away from each other. This creates a vacuum in the outer chamber, which allows air to be drawn into the outer chamber's valve thereby inflating the outer chamber

LISTING OF COMPONENTS

Inner Chamber
103—Inner Chamber Air Valve
104—Primary Horizontal Conduit
105—Vertical Post
105(*a*)—Top of Vertical Post
105 (*b*)—Bottom of Vertical Post
107—Secondary Horizontal Conduit
109—Outer Chamber
111—Outer Chamber Air Valve
Outer Chamber Upper Layer
Outer Chamber Lower Layer
117—Outer Chamber Single Outer Layer
119—Outer Chamber Inner Surface

DETAILED DESCRIPTION OF THE INVENTION

Disclosed is a dual air chamber device having two independent and air impervious chambers.

Figure 1:
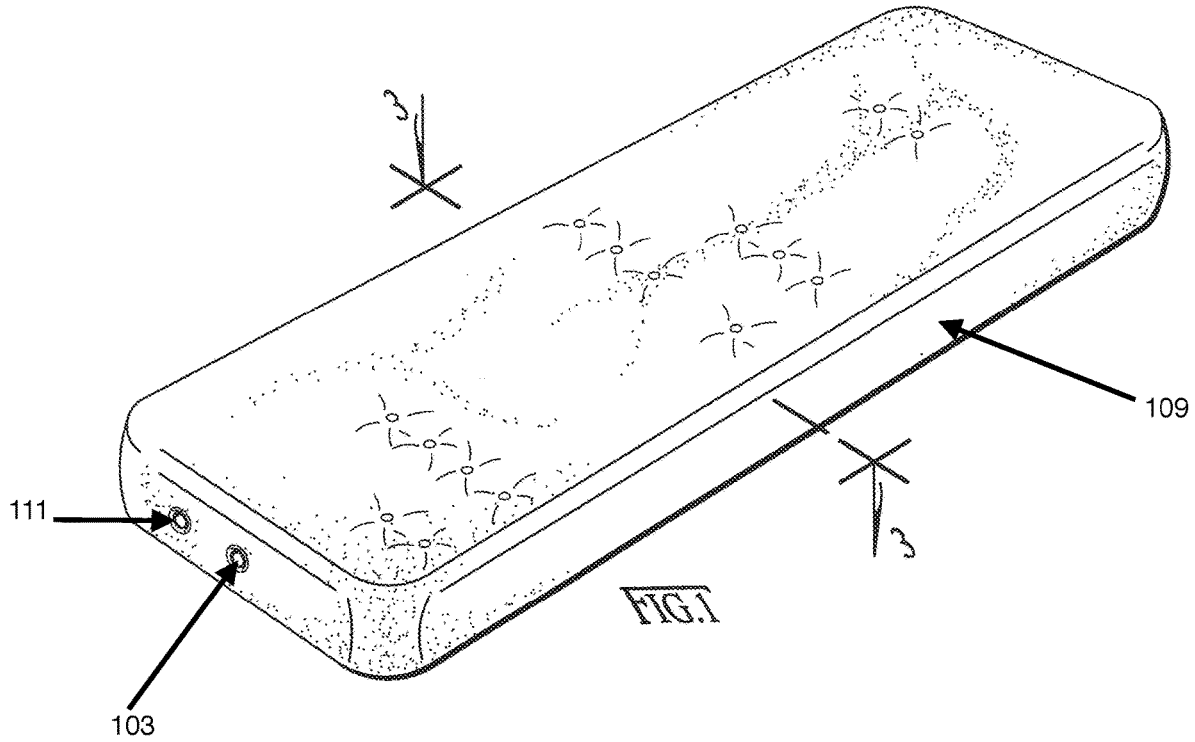
FIG. 1 is an external perspective view of the dual air chamber device.
Figure 2:
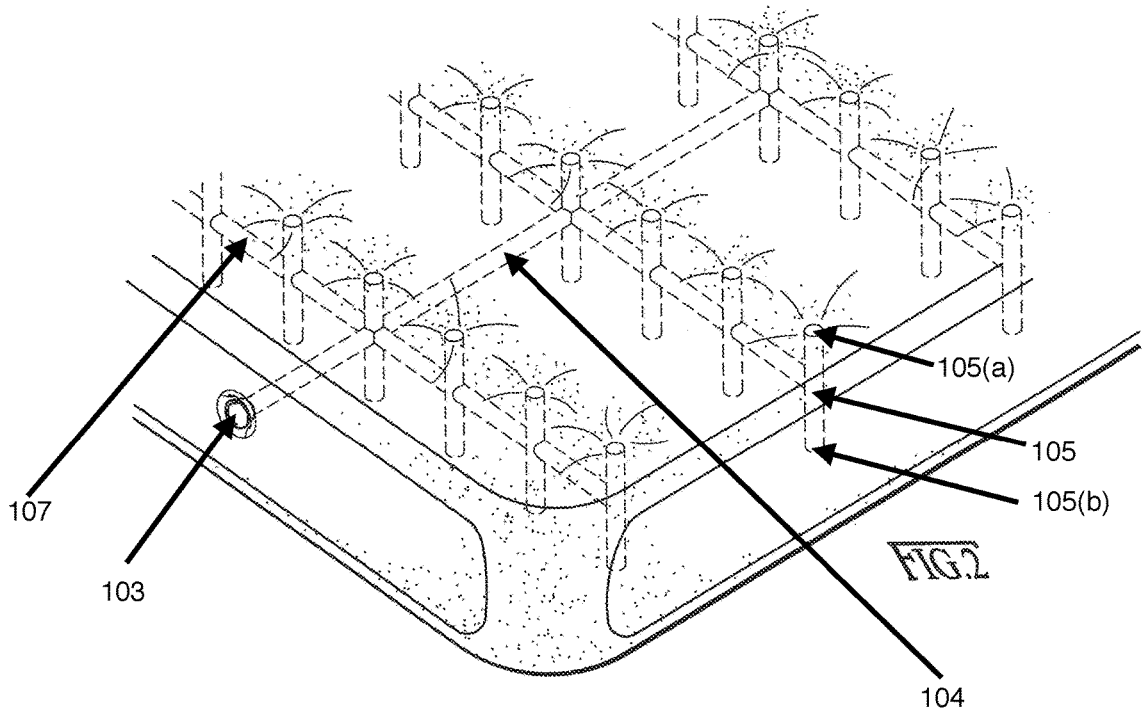
FIG. 2 is an internal perspective view of the dual air chamber device.

The inner chamber, except for its air valve 103, is completely contained by the outer chamber 109. The inner chamber may be comprised of a primary horizontal conduit 104 and a plurality of inflatable intermittent vertical posts 105 made of small diameter tubing which are connected by a corresponding plurality of inflatable horizontal connectors 107 made of small diameter tubing, such that air is free to flow between the primary conduit 104, vertical posts 105, and secondary horizontal conduits 107. As shown in FIG. 2, the inner chamber as a whole (104, 105, 107) represents a continuous unit such that air may flow freely between the primary horizontal conduit 104, a repeating series of inflatable vertical posts 105, and the secondary horizontal conduits 107. The vertical posts 105 and horizontal conduits (104, 107) may be cylindrical in shape, although other shapes may be used. The angle between the vertical posts 105 and horizontal conduits (104, 107) may vary in alternative embodiments. The diameter and overall size, as well as the density of the vertical posts 105 and horizontal conduits (104, 107) may also vary depending on the particular application of the dual air chamber structure.

Figure 3:
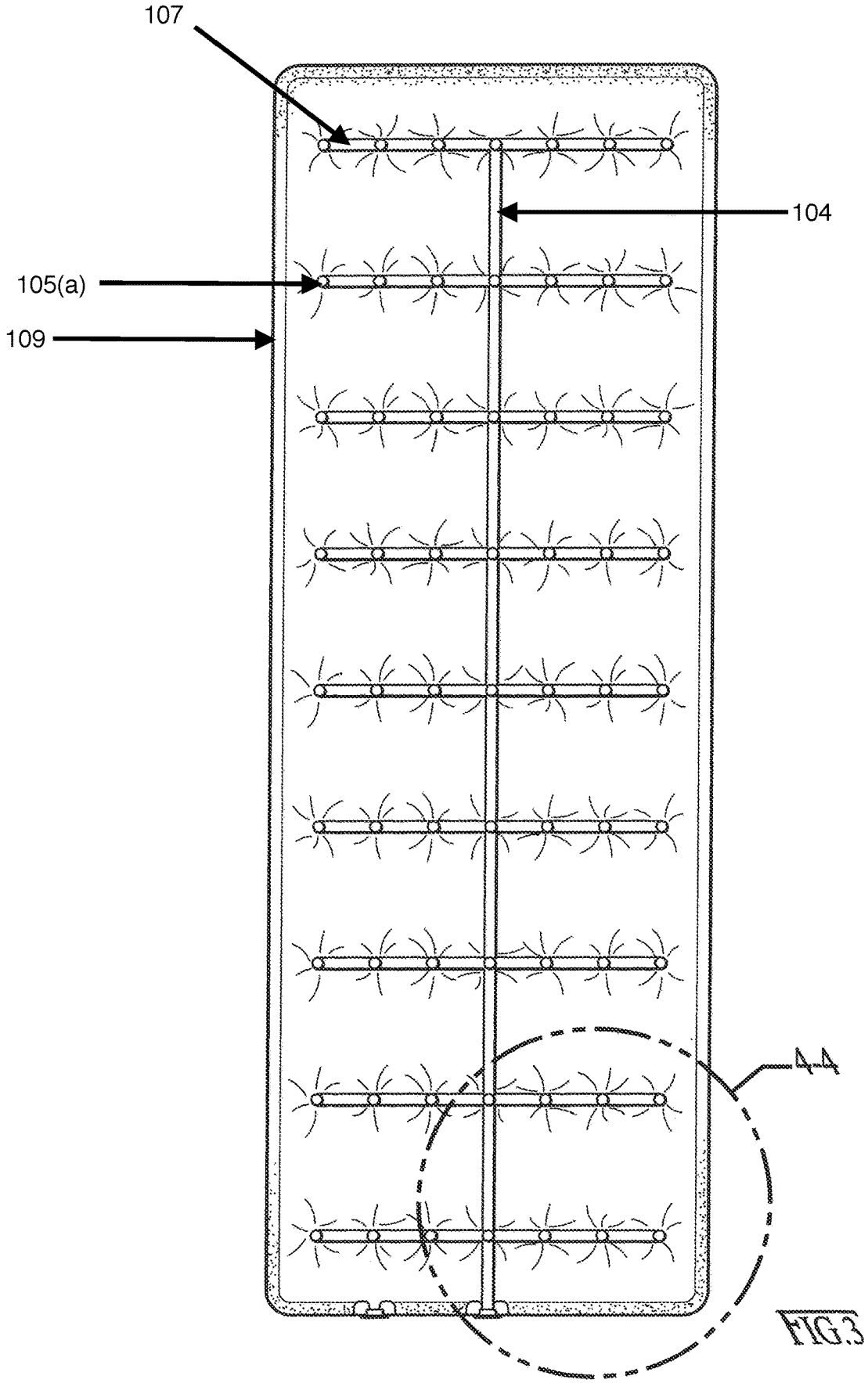
FIG. 3 is a top view of the dual air chamber device.
Figure 4:
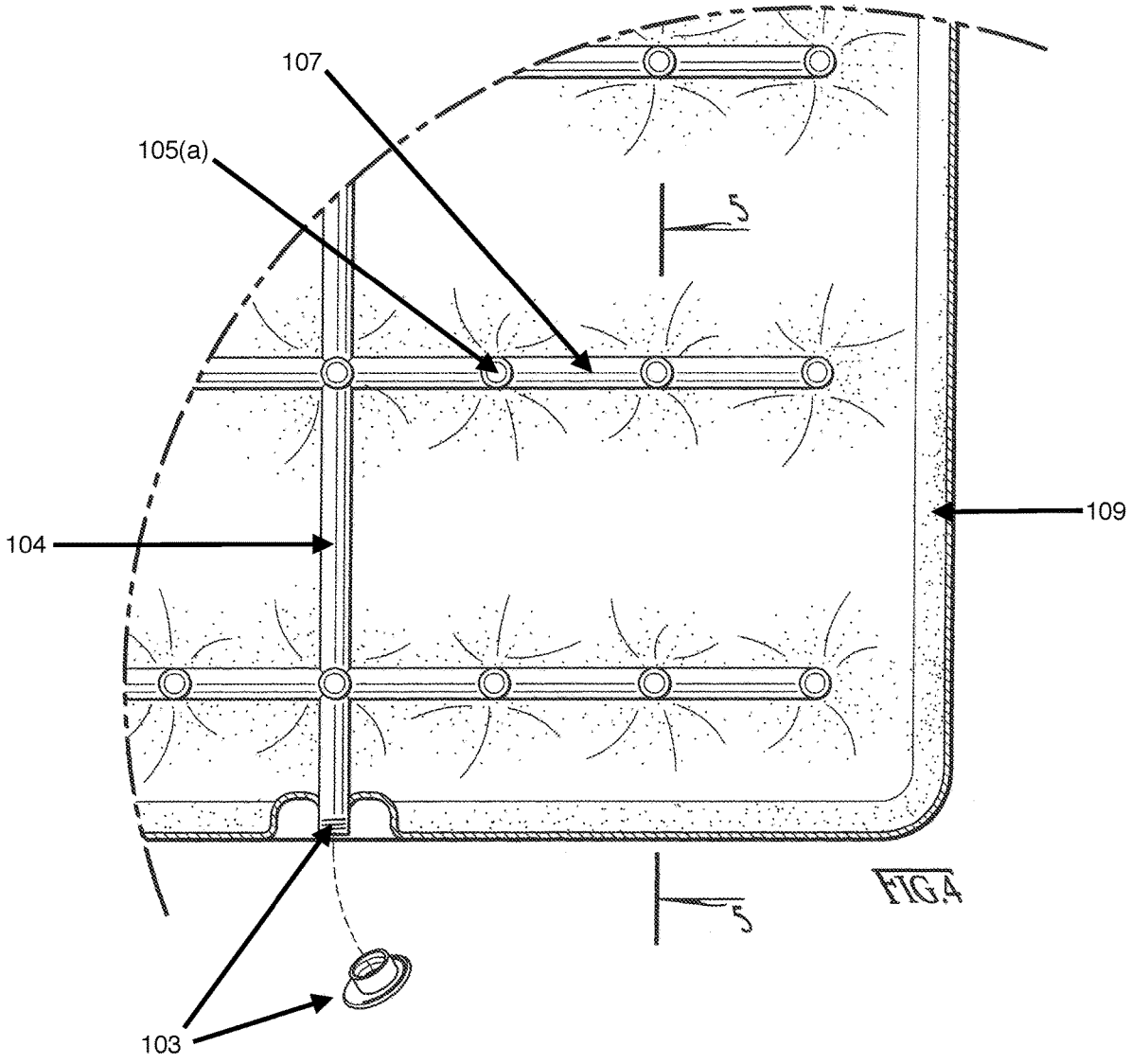
FIG. 4 is a detailed top view of the dual air chamber device.
Figure 5:
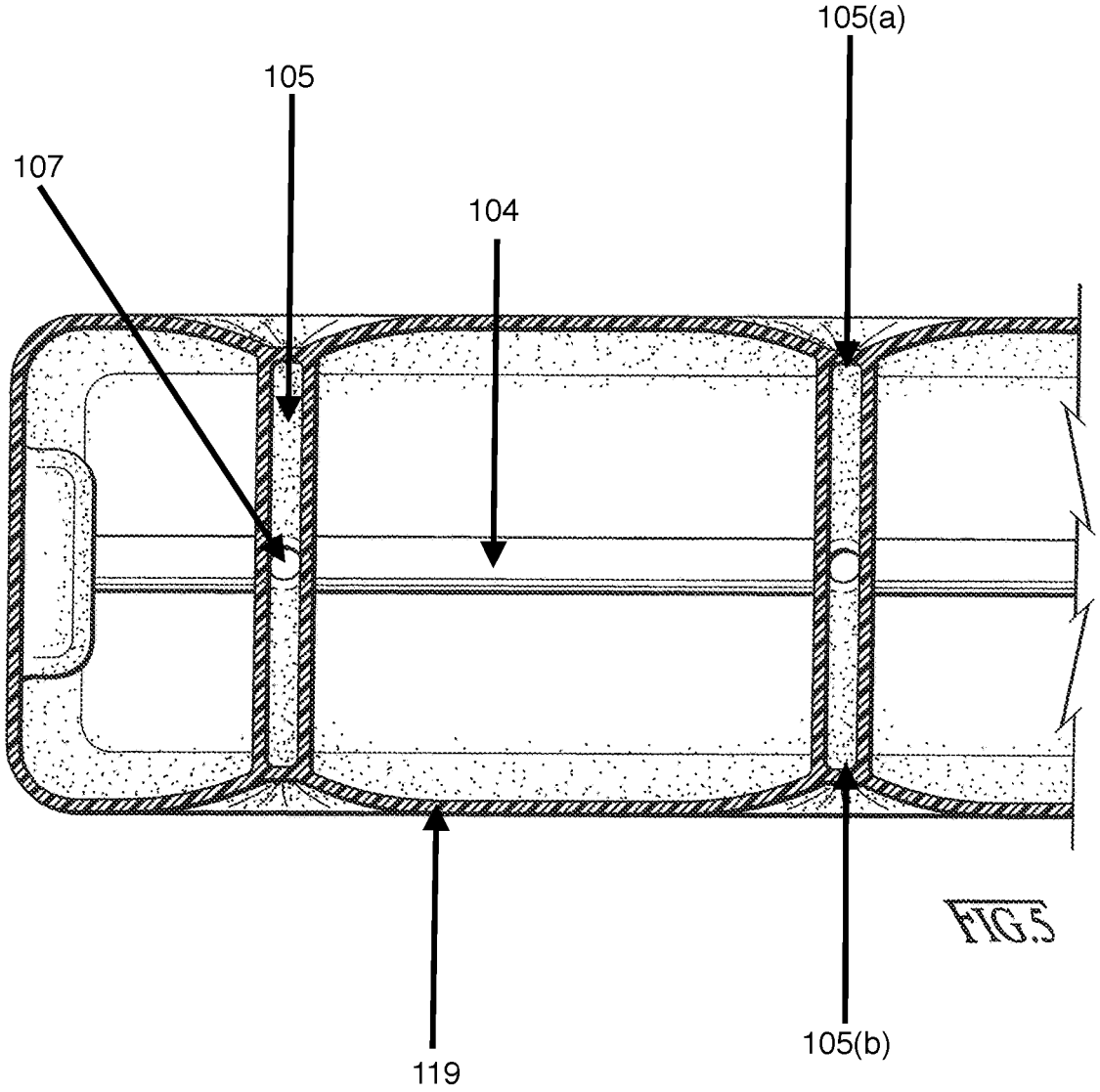
FIG. 5 is an internal side view of the dual air chamber device.
Figure 6:
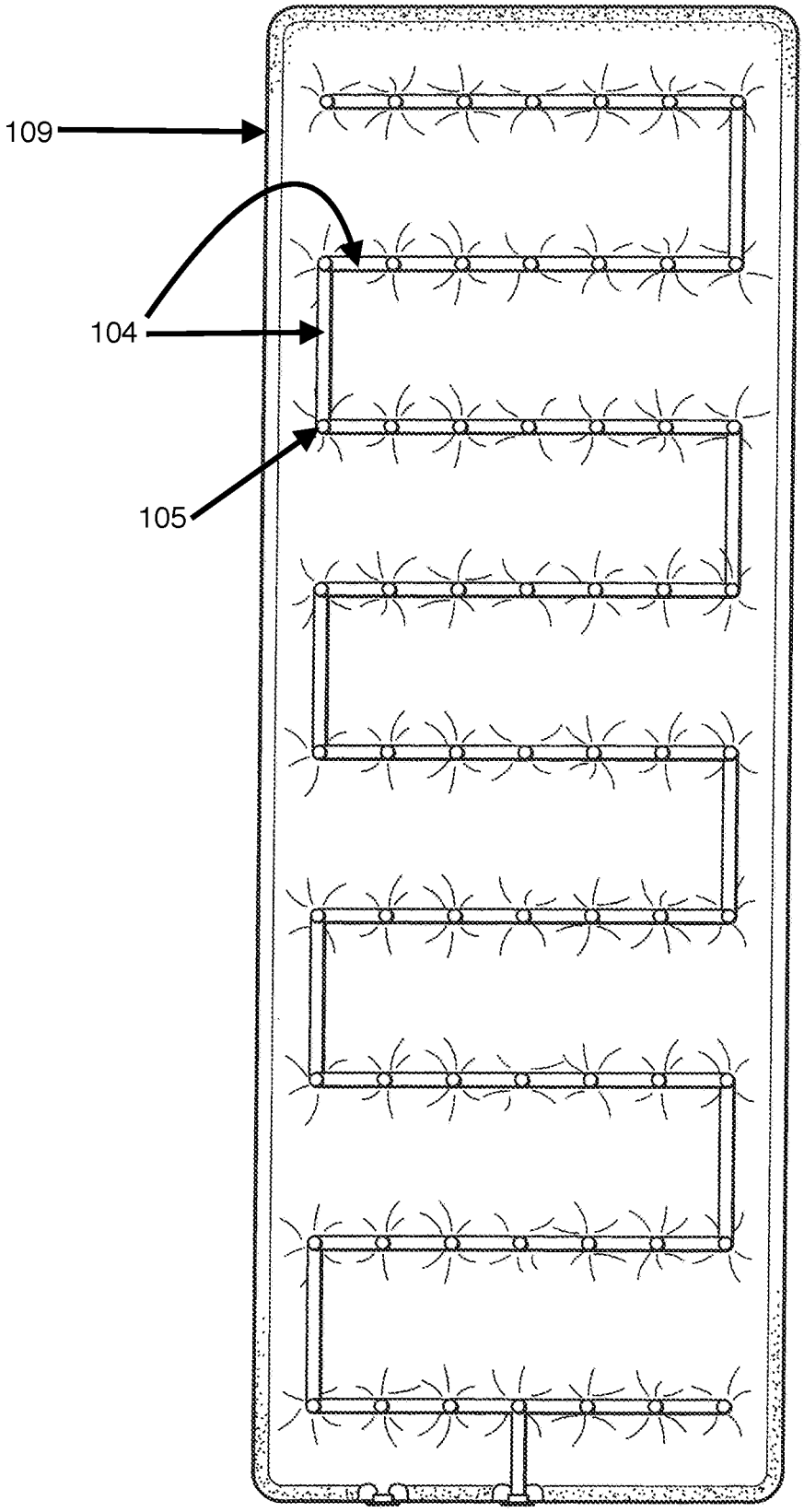
FIG. 6 is a top view of an alternate embodiment of the dual air chamber device.
Figure 7:
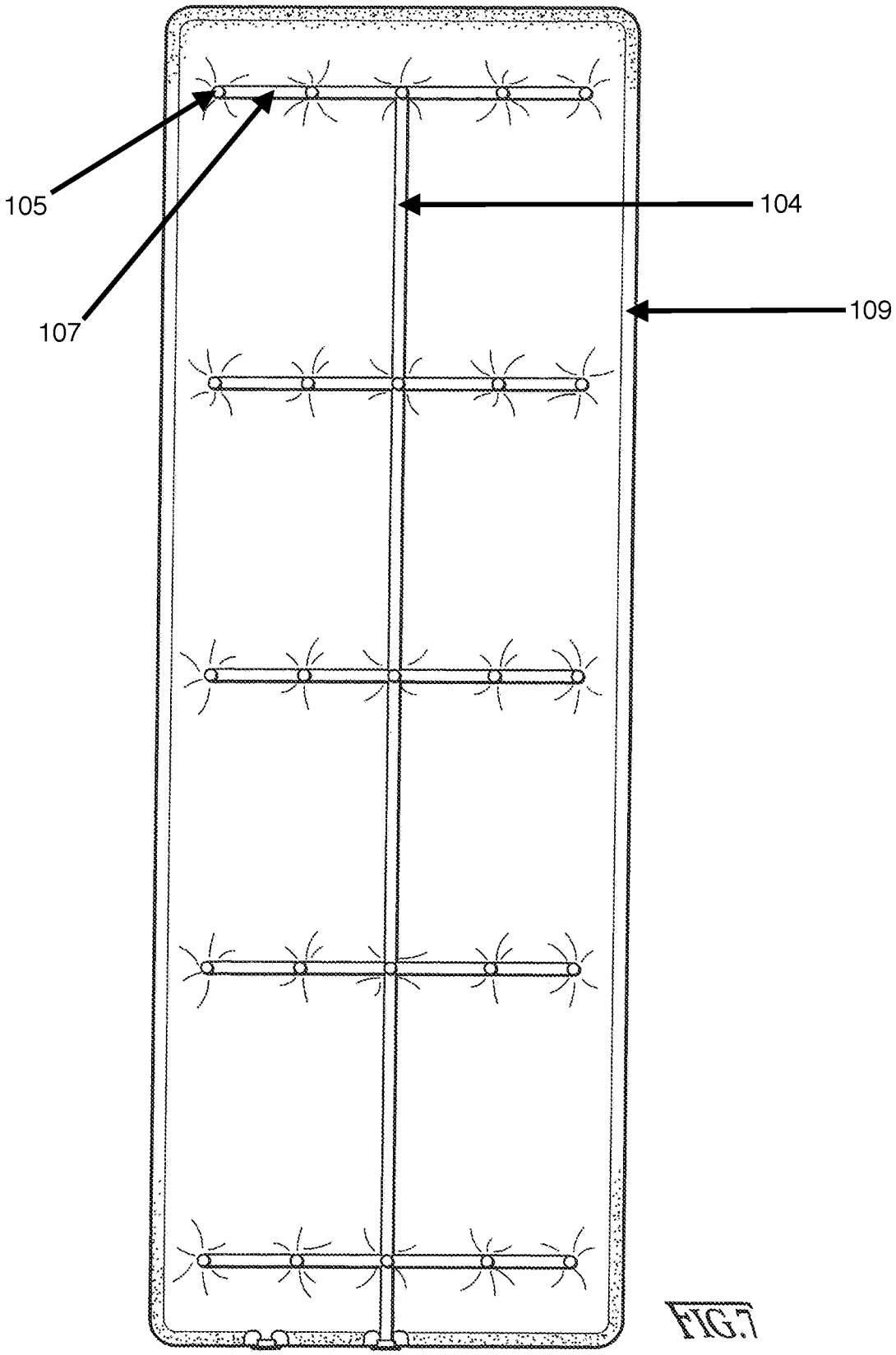
FIG. 7 is a top view of an alternate embodiment of the dual air chamber device.

In one preferred embodiment, as shown in FIG. 3, the inner chamber may be comprised of a primary horizontal conduit 104 having a plurality of secondary horizontal conduits 107, each secondary horizontal conduit 107 having a plurality of intermittent vertical posts 105. In another preferred embodiment, as shown in FIG. 6, the inner chamber may be comprised of a "snaking fence" structure, wherein a primary horizontal conduit 104 contains a plurality of intermittent vertical posts 105. In other preferred embodiments, the structure and or shape of the inner chamber may vary such that each embodiment is defined by a primary and/or secondary horizontal conduits (104, 107) having a plurality of intermittent vertical posts 105.

The outer chamber 109 is comprised of an upper layer and lower layer, such that the two layers are fused together to form an air impervious bladder. In other preferred embodiments, the outer chamber may be comprised of a single outer layer, sealed to form an air impervious bladder. The outer chamber 109 contains an air valve 111.

In one preferred embodiment, the inner surface 119 of the outer chamber 109 contacts the top 105(*a*) and bottom 105(*b*) of each vertical post 105 of the inner chamber 101, thereby sealing the top 105(*a*) and bottom 105(*b*) of each vertical post 105. In other preferred embodiments, the vertical posts 105 of the inner chamber may be sealed independently of the inner surface 119 of the outer chamber 109, such that although the top 105(*a*) and bottom 105(*b*) of each vertical post 105 may still come into contact with the inner surface 119 of the outer chamber 109, the inner surface 119 of the outer chamber 109 does not seal the top 105(*a*) or bottom 105(*b*) of the vertical posts 105.

In each preferred embodiment, as the inner chamber inflates, the vertical posts 105 stand up (inflate), thereby providing a mechanism to force the inner surfaces 119 of the outer chamber 109 away from each other. This creates a vacuum effect in the outer chamber 109, which allows air to be drawn into the outer chamber's air valve 111 thereby inflating the outer chamber 109. This allows a user to quickly and easily inflate the dual air chamber structure, without relying on "self-inflating" means such as open cell foam.

The inner and outer 109 chambers may be made of any material typical to the industry such as rip-stop nylon, polyester, or a polyurethane material. The air valves (103, 111) for each chamber (109) may be of a type typical to the industry, such as a screw type valve.

To inflate the device, a user first opens both air valves (103, 111). As the user pushes air into the inner chamber, the vertical posts 105 inflate, thereby pushing the walls of the outer chamber 109 away from each other. This creates a vacuum effect in the outer chamber 109 causing air to be drawn through the outer chamber's air valve 111. When the inner chamber is inflated to the user's preference, the user closes the inner chamber's air valve 103. At this time, the outer chamber 109 should be almost full of air. A user may add additional air to the outer chamber 109 if desired. Finally, the user should close the outer chamber's air valve 111.

Those in the art will appreciate that the disclosed technology has a number of possible applications. For example, the inventor envisions the device being incorporated into lightweight sleeping pads and mattresses, other inflatable outdoor items such as kayaks and rafts, and other products with a need for such a technology.

I claim:

1. An improved method of inflating a dual air chamber device, said method including the following steps:

A) Providing a dual air chamber device, said device comprising:

1) an outer chamber configured for selectively retaining a volume of air, said outer chamber itself comprising:

a) an outer chamber air valve configured to be either open or closed so as to allow or prevent airflow therethrough, respectively;

b) an upper wall; and c) a lower wall, said upper and lower walls and said air valve configured to combine to at least partially provide a closed chamber configured to retain a volume of air when said outer chamber air valve is closed, 2) an inner chamber configured for selectively retaining a volume of air, said inner chamber itself comprising:

a) an inner chamber air valve configured to be either open or closed so as to allow or prevent airflow therethrough, respectively;

b) a plurality of vertical elongate spaced apart inflatable posts, each of said inflatable posts having a pair of opposing ends being a top end and a bottom end, each of said pairs of opposing ends configured to increase in distance from a shorter distance to a longer distance when air is introduced into their particular post; and c) an interconnected grid of inflatable tubing providing for air communication between said plurality of inflatable posts and said inner chamber air valve, wherein said inflatable tubing and said inflatable posts have substantially the same diameter upon inflation, said plurality of elongate spaced apart inflatable posts, said grid of inflatable tubing, and said air valve configured to combine to at least partially provide a closed chamber configured to retain a volume of air when said inner chamber air valve is closed, said upper wall of outer chamber said having said top ends of said inflatable posts in contact therewith and said lower wall of outer chamber said having said bottom ends of said inflatable posts in contact therewith;

B) providing said outer chamber air valve of said outer chamber in an open configuration;

C) while said outer chamber air valve of said outer chamber is in said open configuration as a result of Step B, inflating said inner chamber by introducing air into said inner chamber air valve while said inner chamber air valve is in an open position, such that as said inner chamber is inflated, its inflatable posts combine to push apart said upper and lower walls of said outer chamber, and such that air tends to be drawn into the open outer chamber air valve in the outer chamber due to the presence of a relative vacuum within said inner chamber, said inner and outer chamber being interconnected such that introduction of air under pressure into said inner chamber causes said inflatable posts to extend in length, such that said top ends of said vertical posts push upwardly against said upper wall, and such that said bottom ends of said vertical posts push downwardly against said lower wall, causing said upper wall to move upwardly away from said lower wall, such that a vacuum is provided within said outer chamber, said vacuum being sufficient to cause air to be drawn into said outer chamber air valve when in its open position;

D) after said air has been drawn into said outer chamber while said outer chamber air valve of said outer chamber is in said open configuration, closing said inner chamber air valve to a closed configuration; and E) while said inner chamber air valve of said inner chamber is in said closed configuration as a result of Step D, closing said outer chamber air valve to retain said air drawn into said outer chamber due to said vacuum.

2. The dual air chamber device of claim 1, wherein in Step "A", said top ends and bottom ends of said plurality of said spaced apart inflatable posts are sealed by an inner surface of the outer chamber such that said inner chamber holds and contains air or fluid completely independent of said outer chamber.

3. The dual air chamber of device of claim 1, wherein in Step "A", said top ends and bottom ends of said plurality of said spaced apart inflatable posts are sealed independently of an inner surface of the outer chamber.

4. The dual air chamber device of claim 1, wherein in Step "A", said top ends of said spaced apart inflatable posts are in contact with said upper wall at discretely spaced apart top contact locations located in a substantially horizontal first plane, wherein in Step "A", said bottom ends of said spaced apart inflatable posts are in contact with said lower wall at discretely spaced apart bottom contact locations located in a substantially horizontal second plane, and wherein in Step "A", said spaced apart inflatable posts are elongate and include longitudinal axes which are substantially normal to said first and second horizontal planes.

5. The dual air chamber device of claim 4, wherein in Step "A", said interconnected inflatable posts form an inflatable post grid comprised of a plurality of inflatable post rows and a plurality of inflatable post columns, said columns being substantially perpendicular to said rows, and wherein in Step "A", said top contact locations and said bottom contact locations likewise form corresponding grids having rows and columns, all of which combine to provide upper and lower grids of spaced apart contact points which push up and down against said upper and lower walls, respectively, upon inflation of said inner chamber.

6. An improved method of inflating a dual air chamber device, said method including the following steps:

A) Providing a multi compartmental supporting device having at least two chambers, an inner chamber and an outer chamber, said outer chamber including an upper and a lower wall, and also including a selectively closable outer chamber valve for allowing air in and out of said outer chamber, said inner chamber itself comprised of a plurality of spaced apart inflatable posts, each of which has its top end in contact with said upper wall of the outer chamber, and each of which has its bottom end in contact with said lower wall of the outer chamber, said inner chamber also including a selectively closable inner chamber valve for allowing air in and out of said inner chamber;

said inner chamber valve independently operable relative to said outer chamber valve, such that said outer chamber valve can be left open while said inner chamber valve is open and said inner chamber is inflated, B) providing said selectively closable outer chamber valve of said outer chamber in an open configuration;

C) while said outer chamber valve of said outer chamber is in said open configuration as a result of Step B, inflating said inner chamber by introducing air into said inner chamber valve while said inner chamber valve is in an open position, such that as said inner chamber is inflated, its inflatable posts combine to push apart said upper and lower walls of said outer chamber, and such that air is drawn into the open outer chamber valve in the outer chamber due to the presence of a relative vacuum within said inner chamber, D) after said air has been drawn into said outer chamber while said outer chamber valve of said outer chamber is in said open configuration, closing said inner chamber valve to a closed configuration; and E) while said inner chamber valve of said inner chamber is in said closed configuration as a result of Step D, closing said outer chamber valve to retain said air drawn into said outer chamber due to said vacuum.

7. The dual air chamber device of claim 6, wherein in Step "A", said top ends and bottom ends of said plurality of said spaced apart inflatable posts are sealed by an inner surface of the outer chamber such that said inner chamber holds and contains air or fluid completely independent of said outer chamber.

8. The dual air chamber of device of claim 6, wherein in Step "A", said top ends and bottom ends of said plurality of said spaced apart inflatable posts are sealed independently of an inner surface of the outer chamber.

9. The dual air chamber device of claim 6, wherein in Step "A", said top ends of said spaced apart inflatable posts are in contact with said upper wall at discretely spaced apart top contact locations located in a substantially horizontal first plane, wherein in Step "A", said bottom ends of said spaced apart inflatable posts are in contact with said lower wall at discretely spaced apart bottom contact locations located in a substantially horizontal second plane, and wherein in Step "A", said spaced apart inflatable posts are elongate and include longitudinal axes which are substantially normal to said first and second horizontal planes.

10. The dual air chamber device of claim 9, wherein in Step "A", said interconnected inflatable posts form an inflatable post grid comprised of a plurality of inflatable post rows and a plurality of inflatable post columns, said columns being substantially perpendicular to said rows, and wherein in Step "A", said top contact locations and said bottom contact locations likewise form corresponding grids having rows and columns, all of which combine to provide upper and lower grids of spaced apart contact points which push up and down against said upper and lower walls, respectively, upon inflation of said inner chamber.

11. An improved method of inflating a multi compartmental supporting device, said method including the following steps:

A) Providing a multi compartmental supporting device having at least two chambers, an inner chamber and an outer chamber, said outer chamber including an upper and a lower wall, and also including a selectively closable outer chamber valve for allowing air in and out of said outer chamber, said inner chamber itself comprised of a plurality of spaced apart inflatable posts, each of which has its top end in contact with said upper wall of the outer chamber, and each of which has its bottom end in contact with said lower wall of the outer chamber, said inner chamber also including a selectively closable inner chamber valve for allowing air in and out of said inner chamber;

said inner chamber also including a plurality of horizontal conduits configured to allow air introduced into said inner chamber valve to be communicated to said inflatable vertical posts;

said inner chamber valve independently operable relative to said outer chamber valve, such that said outer chamber valve can be left open while said inner chamber valve is open and said inner chamber is inflated, B) providing said selectively closable outer chamber valve of said outer chamber in an open configuration;

C) while said outer chamber valve of said outer chamber is in said open configuration as a result of Step B, inflating said inner chamber by introducing air into said inner chamber valve while said inner chamber valve is in an open position, such that as said inner chamber is inflated, its inflatable posts combine to push apart said upper and lower walls of said outer chamber, and such that air is drawn into the open outer chamber valve in the outer chamber due to the presence of a relative vacuum within said inner chamber, D) after said air has been drawn into said outer chamber while said outer chamber valve of said outer chamber is in said open configuration, closing said inner chamber valve to a closed configuration; and E) while said inner chamber valve of said inner chamber is in said closed configuration as a result of Step D, closing said outer chamber valve to retain said air drawn into said outer chamber due to said vacuum.

12. The dual air chamber device of claim 11, wherein in Step "A", said top ends and bottom ends of said plurality of said spaced apart inflatable posts are sealed by an inner surface of the outer chamber such that said inner chamber holds and contains air or fluid completely independent of said outer chamber.

13. The dual air chamber of device of claim 11, wherein in Step "A", said top ends and bottom ends of said plurality of said spaced apart inflatable posts are sealed independently of an inner surface of the outer chamber.

14. The dual air chamber device of claim 11, wherein in Step "A", said top ends of said spaced apart inflatable posts are in contact with said upper wall at discretely spaced apart top contact locations located in a substantially horizontal first plane, wherein in Step "A", said bottom ends of said spaced apart inflatable posts are in contact with said lower wall at discretely spaced apart bottom contact locations located in a substantially horizontal second plane, and wherein in Step "A", said spaced apart inflatable posts are elongate and include longitudinal axes which are substantially normal to said first and second horizontal planes.

15. The dual air chamber device of claim 14, wherein in Step "A", said interconnected inflatable posts form an inflatable post grid comprised of a plurality of inflatable post rows and a plurality of inflatable post columns, said columns being substantially perpendicular to said rows, and wherein in Step "A", said top contact locations and said bottom contact locations likewise form corresponding grids having rows and columns, all of which combine to provide upper and lower grids of spaced apart contact points which push up and down against said upper and lower walls, respectively, upon inflation of said inner chamber.

* * * * *